United States Patent [19]

Klimpke

[11] Patent Number: 4,821,660

[45] Date of Patent: Apr. 18, 1989

[54] MULTINEEDLE AUTOMATIC SEWING MACHINE

[76] Inventor: Dirk Klimpke, Am Johannisbach 35, 4800 Bielefeld 1, Fed. Rep. of Germany

[21] Appl. No.: 76,381

[22] Filed: Jul. 22, 1987

[51] Int. Cl.[4] ..... D05B 1/08; D05B 69/36

[52] U.S. Cl. ..... 112/164; 112/273; 112/275

[58] Field of Search ..... 139/371; 112/275, 273, 112/164, 171

[56] References Cited

U.S. PATENT DOCUMENTS

| | | | |
|---|---|---|---|
| 1,052,955 | 2/1913 | Poirier | 112/273 |
| 2,796,035 | 6/1957 | Bryson | 112/273 |
| 3,732,834 | 5/1973 | Mayer | 112/273 |
| 4,021,896 | 5/1977 | Stierlein | 112/171 |

FOREIGN PATENT DOCUMENTS 52610 12/1966 German Democratic Rep. .

*Primary Examiner*—Andrew M. Falik

*Attorney, Agent, or Firm*—Spencer & Frank

[57] ABSTRACT

A multineedle automatic sewing machine has a needle holder which is vertically movable above a needle plate. The needle holder has needles which are supplied with upper threads unwinding from spools, and with shuttles which contains spools with lower threads. The shuttles are arranged on horizontally displacable shuttle holders below the needle plate. Each shuttle contains an electric circuit in which the shuttle, together with an associated contact plate, is arranged on the lower side of the needle plate, functioning as an electric switch so that the machine is switched off in the case of the breaking of one single lower thread.

7 Claims, 3 Drawing Sheets

MULTINEEDLE AUTOMATIC SEWING MACHINE

BACKGROUND OF THE INVENTION

The invention relates to a textile machine which is designed as a sewing machine in the form of a multineedle automatic stitching device, with a vertically movable needle holder above a needle plate, whose needles are supplied with upper threads unrolling from spools, and below the needle plate, shuttles arranged on horizontally movable shuttle holders, which contain spools with lower threads.

In the case of one such known textile machine, the shuttle with the lower thread always passes during sewing through a loop in the upper thread. Therefore, the spatial measurements for the shuttle and for the shuttle holder carrying it and moving back and forth are limited. It can occur in a multineedle automatic stitching device of this kind that in operation a single thread breaks, so that the corresponding seam cannot be executed, while the sewing workpiece continues to move through the machine and the subsequent seams are executed. In this case, a labor-intensive follow up work would be required, which is undesirable. There are, therefore, already known thread-monitoring devices for textile machines which effect an instantaneous switching off of the machine when only one single thread breaks. These known thread monitors work on the light source-photocell principle and can be installed where sufficient space is available. These known thread monitors are therefore installed, as an example, for monitoring the upper threads.

SUMMARY OF THE INVENTION

The objective underlying the invention is to further develop the textile machine so that also the lower threads can be easily monitored, so that the machine can be switched off automatically in the case of breaking of one single lower thread. This monitoring should take place without a large space requirement being necessary for construction purposes in the area of the threads unrolling from the spools in the shuttles.

This objective is achieved according to the invention by that the machine is equipped with an electrical control circuit which contains a particular electrical circuit for each shuttle, wherein the shuttle together with an associated contact plate arranged on the lower side of the needle plate acts as an electrical switch. In the course of the back and forth movement of the shuttle holder, the shuttle is slightly raised as a result of the thread tension of the lower thread when the shuttle reaches its end position in its return movement. The rear end of the shuttle thus strikes the contact plate, so that the current circuit of this shuttle is closed. The electrical control now is wired so that when this contact closure fails to occur, the machine is switched off, so that further sewing of all the seams is suspended.

Preferably, the needle plate consists of a horizontally arranged metal sheet on whose lower side an electrically nonconductive insulating layer is located, on which are arranged a plurality of identical contact plates spaced from one another in at least one row. The contact plates thus are electrically insulated from the needle plate consisting of sheet metal, so that the formation of electrical circuits in which the contact plates in each case are comprised is possible. A series of contact plates extend according to the arrangement of the associated shuttles perpendicularly to the direction of displacement of the shuttle holders, and thus over the width of the sewing workpiece to be worked upon.

Preferred embodiment forms of the invention are contained in the protective claims. The scope of protection extends not only to the individually claimed features but also to their combination.

BRIEF DESCRIPTION OF THE DRAWING

An embodiment example of the invention is represented in the drawing and is described below in more detail. There are shown.

DESCRIPTION OF THE PREFERRED EMBODIMENTS

Figure 1:
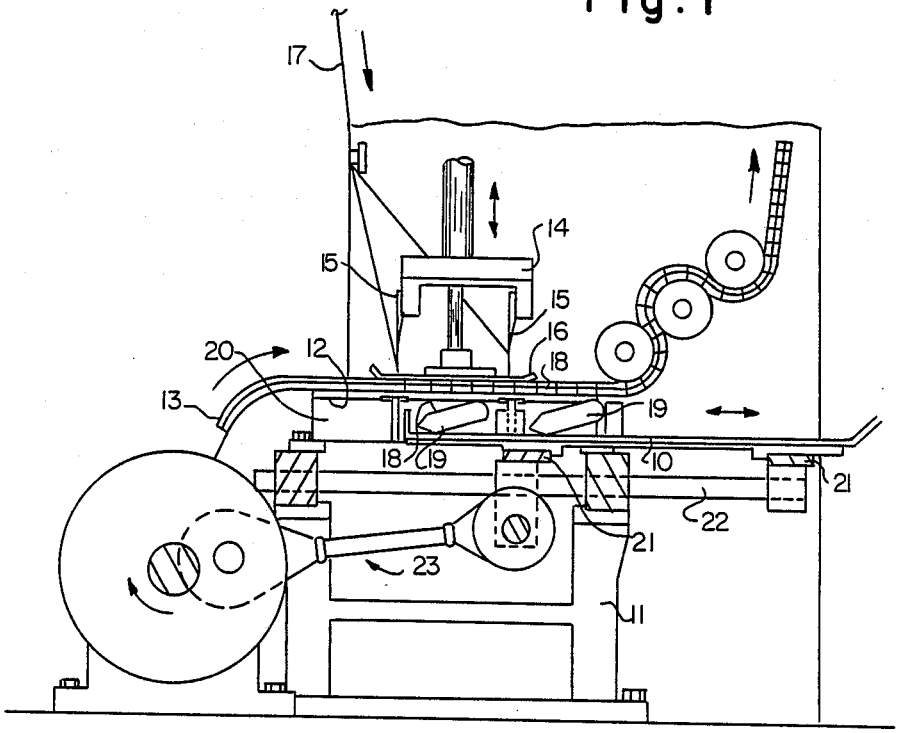
in FIG. 1 a side view of a textile machine with a partial vertical cross-section.
Figure 2:
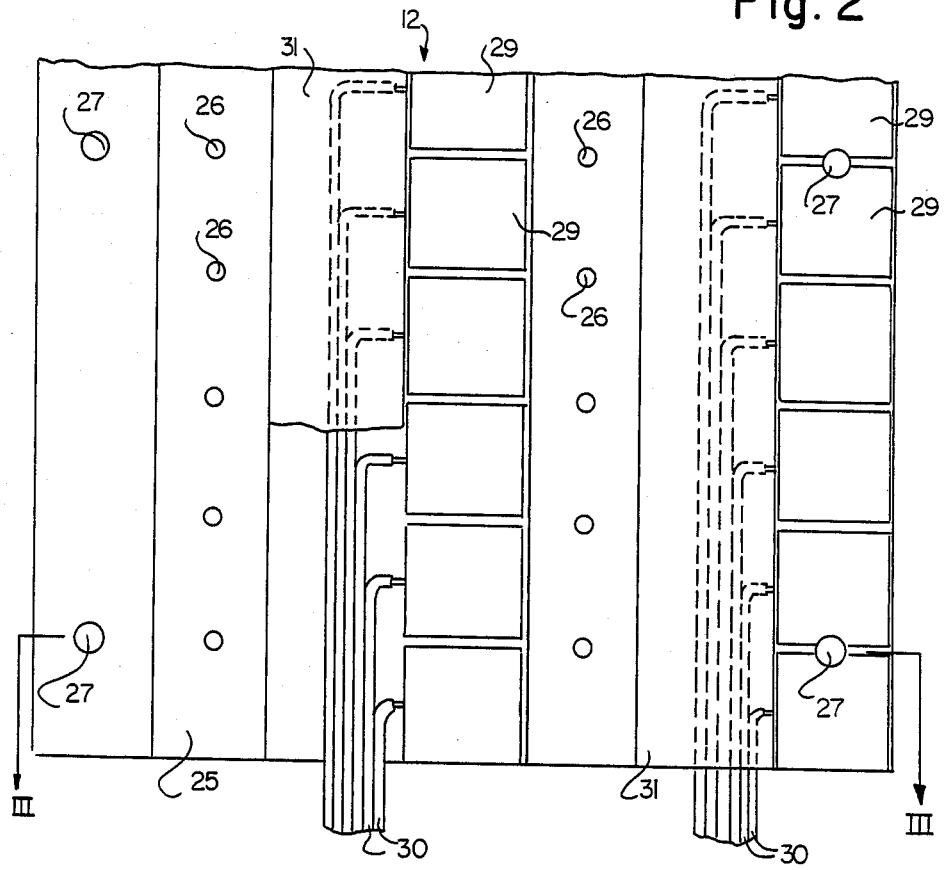
in FIG. 2 a bottom view of a needle plate of the textile machine.
Figure 3:
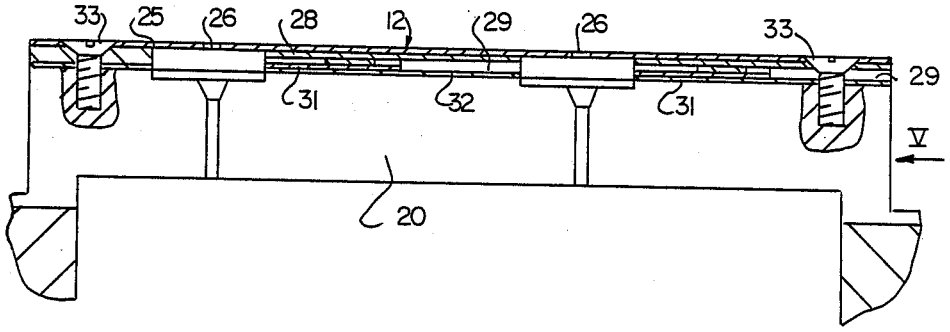
in FIG. 3 a vertical cross-section through the needle plate according to line III—III of FIG. 2, wherein the partition supporting the needle plate is essentially shown in a view.
Figure 4:
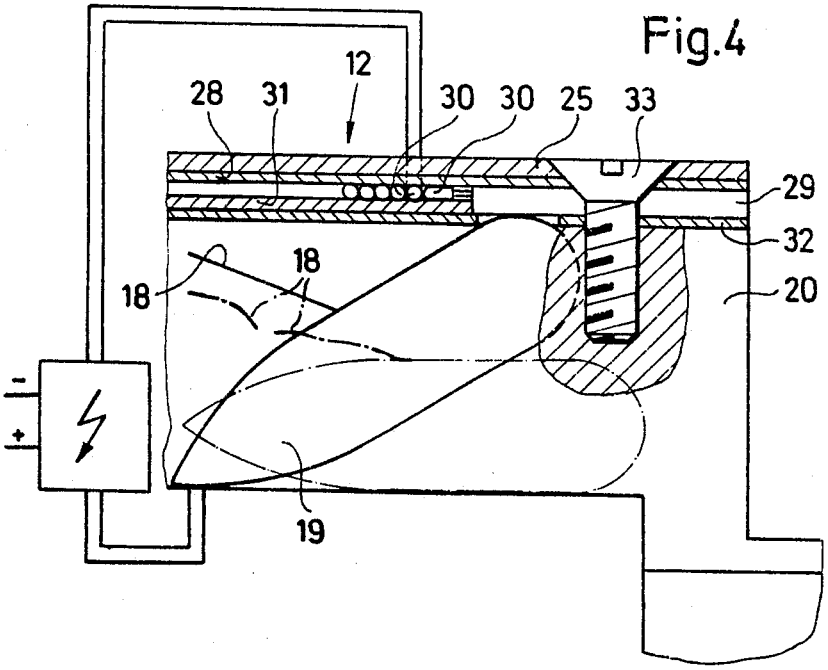
in FIG. 4 an enlarged representation of the right hand region of the needle plate and of the partition according to FIG. 3.
Figure 5:
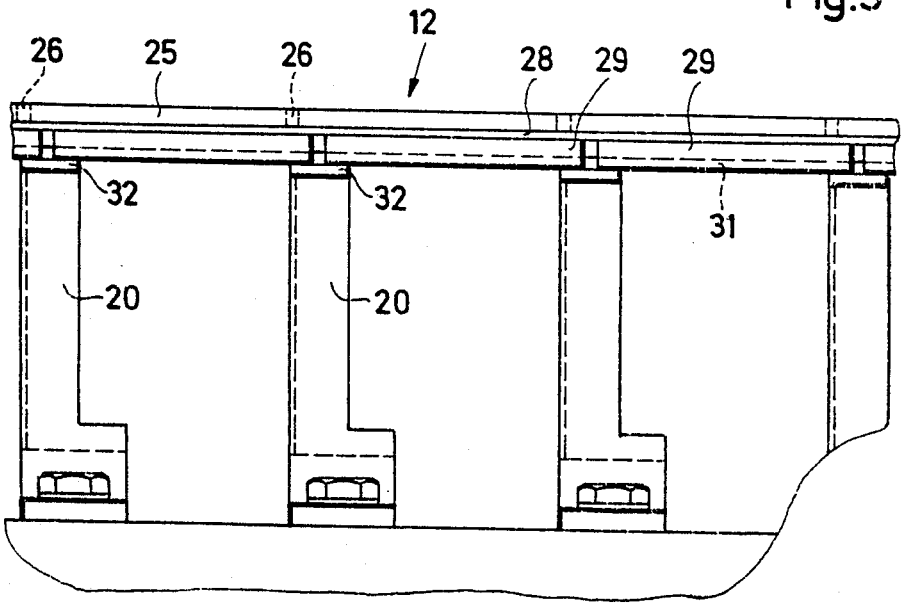
in FIG. 5 a view of the needle plate and of the partition as seen in the direction of the arrow V of FIG. 3.

The textile machine contains a plurality of identical parallel shuttle holders 10, which are displaceably arranged horizontally on a machine frame 11. They are located under a stationary horizontal needle plate 12 upon which the sewing workpiece 13 moves through, wherein above the sewing workpiece a needle holder 14 with vertical needles 15 arranged behind one another in the direction of work, above a pressure plate 18 is installed vertically movable up and down. From the rollers installed on the machine but not shown, upper threads 17 run to the needles 15 and, together with the lower threads 18 are sewn into the workpiece 13.

Each lower thread 18 is wound on a spool which is located within a shuttle 19. In the embodiment example, there are two rows of shuttles 19, which in each case extend perpendicularly to the direction of work and are arranged behind one another in the direction of work. Two shuttles 19 lying behind each other are in each case supported by one shuttle holder 10.

Between each two shuttle holders 10 are located stationary partitions 20, which are arranged spaced from one another and thus form channel-shaped shuttle races in which the shuttle holders 10, and with them the shuttles 19, are arranged displaceable back and forth in the direction of work. Two shuttles 18 lying behind each other are in each case supported by one shuttle holder 10. Moreover, all the shuttle holders 10 are supported by two crossmembers 21, arranged behind each other, which are displaceably installed by means of horizontally displaceable guide spars 22 on the machine frame 11. A crank mechanism 23 provides for the displacement.

Each shuttle is slightly liftable in its mounting place on the shuttle holder below the needle plate 12. Lifting always occurs as a result of the thread tension of the lower thread 18 when the shuttle holder 10, and with it the shuttle 19, have reached an end position in the back and forth movement. In the course of this lifting of the shuttle 19, it strikes a contact plate 29 attached to the lower side of the needle plate 12, whereby an electrical circuit is closed, which flows through across the metallic contact plate 29 and the metallic shuttle. The regular closing of this electrical circuit, together with the regular closing of all the other similarly produced electrical circuits, effects the retention of the switched on condition of the machine. As soon as a lower thread 18 is broken, so that lifting of the shuttle during the operation can no longer occur, the circuit, as a result of the absence of the electrical contact closing, receives the signal to immediately switch off the entire machine.

The needle plate 12 is formed as a thin metal sheet 25, which exhibits a plurality of tap holes 26 for the needles 15 and a plurality of fastening holes 27 for fastening to the machine. Underneath this metal sheet 25, there is arranged, as an example, bonded, an electrically nonconductive insulating layer 28. On this insulating layer 28, on the lower side of the metal sheet 25, there are now installed contact plates 29, which are located above the shuttles 19. To each contact plate 29 leads an electrically insulated conductor 30 of the electrical circuit containing the contact plate 29 and the shuttle associated with it. All the conductors 30 of one row run perpendicularly to the direction of work in the needle plate 12 and form a common bundle. Since in the embodiment example, corresponding to both rows of needles 15, also two rows of shuttles 19 and contact plates 29 are provided, two parallel bundles of conductors 30 result. Each channel containing the conductors 30 is covered on the lower side of the needle plate 12 with a covering strip 31. In order to electrically insulate the needle plate 12 from the partitions 20, they are covered on the upper horizontal sides adjacent the needle plate 12, with electrically nonconductive insulating layers 32 on which the needle plate 12 with the contact plates 29 rest.

The fastening of the needle plate 12 to the machine can be performed with screws 33, which are inserted through the fastening holes 27 of the needle plate 12 and are screwed into threaded holes of the partitions 20 lying underneath. So that these screws 33, however, do not cause short circuits in the electrical circuits in which the shuttles 19 and the contact plates 29 are located, the screws 33 must consist of an electrically nonconductive material. It is also possible, however, to make use of other construction methods for attaching the needle plate 12 to the machine in an electrically insulating manner.

I claim:

1. Textile machine which is designed as a sewing machine in the form of a multineedle automatic stitching device, with a needle holder vertically movable above a needle plate, whose needles are supplied with upper threads unwinding from spools, and, with shuttles, which contain spools with lower threads, arranged on horizontally displaceable shuttle holders below the needle plate, characterized by that the machine is equipped with electrical control means which for each shuttle (19) contains a particular electrical circuit, in which the shuttle (19) together with an associated contact plate (29) arranged on the lower side of the needle plate (12) functions as an electric switch, wherein the machine is switched off in the case of breaking of one single lower thread.

2. Machine of claim 1, characterized by that the needle plate (12) consists of a horizontal metal sheet (25) on whose lower side an electrically nonconductive insulating layer (28) is located, on which a plurality of identical contact plates (29) are arranged spaced from one another in at least one row.

3. Machine of claim 1, characterized by that the parallel partitions (20), which in each case define a channel-shaped shuttle race, are covered on their upper sides adjacent the needle plate (12) with electrically nonconductive insulating layers (32), on which the needle plate (12) with the contact plates (29) rests.

4. Machine of claim 3, characterized by that the needle plate (12) is attached to the individual partitions (20) by means of screws (33) of an electrically nonconductive material.

5. Machine of claim 1, characterized by that each contact plate (28) is connected to an insulated electrical conductor (30) arranged below the needle plate (12).

6. Machine of one of claim 1, characterized by that all the conductors (30) which lead on the lower side of the needle plate (12) to the contact plates (29) of one row, run perpendicularly to the horizontal direction of movement of the shuttles (19) and are combined into a bundle.

7. Machine of claim 1, characterized by that on the lower side of the needle plate (12), underneath the conductors (30) of each bundle, a covering strip (31) of an electrically nonconductive material is applied.

* * * * *